US010703592B2

(12) United States Patent
Iwasaki

(10) Patent No.: US 10,703,592 B2
(45) Date of Patent: Jul. 7, 2020

(54) FEEDING APPARATUS, AND IMAGE FORMING SYSTEM

(71) Applicant: CANON FINETECH NISCA INC., Misato-shi (JP)

(72) Inventor: Shin Iwasaki, Kashiwa (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/196,368

(22) Filed: Nov. 20, 2018

(65) Prior Publication Data

US 2019/0161296 A1 May 30, 2019

(30) Foreign Application Priority Data

Nov. 24, 2017 (JP) ..... 2017-226028
Nov. 9, 2018 (JP) ..... 2018-211660

(51) Int. Cl.
*B65H 1/18* (2006.01)
*B65H 3/56* (2006.01)
(Continued)

(52) U.S. Cl.
CPC ..... *B65H 1/18* (2013.01); *B65H 1/14* (2013.01); *B65H 1/266* (2013.01); *B65H 3/56* (2013.01); *B65H 7/02* (2013.01); *B65H 43/06* (2013.01); *G03G 21/1642* (2013.01); *B65H 2405/15* (2013.01); *B65H 2405/31* (2013.01); *B65H 2405/313* (2013.01); *B65H 2511/152* (2013.01)

(58) Field of Classification Search
CPC ..... B65H 1/18; B65H 2405/31; B65H 2511/152; B65H 43/06
See application file for complete search history.

(56) References Cited

U.S. PATENT DOCUMENTS 4,718,658 A * 1/1988 Hirose ..... B65H 1/04 271/145
5,480,131 A 1/1996 Furukawa et al.
(Continued)

FOREIGN PATENT DOCUMENTS

JP 59-78047 A 5/1984
JP 61-145045 A 7/1986
(Continued)

OTHER PUBLICATIONS

Office Action dated Dec. 20, 2019, in Japanese Patent Application No. 2018-211660.

*Primary Examiner* — Jeremy R Severson
(74) *Attorney, Agent, or Firm* — Venable LLP

(57) ABSTRACT

A feeding apparatus feeds sheets to an apparatus serving as a feeding destination. A sheet storage unit stores the sheets and is able to be pulled out from the feeding apparatus. A stacking unit stacks the sheets. A detection unit detects a connected state and a separated state. A control unit places the uppermost sheet stacked on the stacking unit at a predetermined height when the detection unit detects the connected state. A control unit lowers the stacking unit so as to move the uppermost sheet at the predetermined height on the stacking unit to a position lower than the predetermined height in accordance with detection of a change from the connected state to the separated state by the detection unit.

10 Claims, 6 Drawing Sheets

(51) Int. Cl.

| | |
|---|---|
| ***B65H 1/26*** | (2006.01) |
| ***B65H 7/02*** | (2006.01) |
| ***B65H 1/14*** | (2006.01) |
| ***G03G 21/16*** | (2006.01) |
| ***B65H 43/06*** | (2006.01) |

(56) References Cited

U.S. PATENT DOCUMENTS

| | | | | |
|---|---|---|---|---|
| 7,419,152 | B2 * | 9/2008 | Adachi | B65H 3/48 271/31 |
| 9,309,065 | B2 * | 4/2016 | Brown | B65H 1/26 |
| 9,309,070 | B2 | 4/2016 | Tanio | |
| 10,040,651 | B2 | 8/2018 | Satake | |

FOREIGN PATENT DOCUMENTS

| | | | |
|---|---|---|---|
| JP | 06-271096 | A | 9/1994 |
| JP | 2006-008299 | A | 1/2006 |
| JP | 2006-213490 | A | 8/2006 |
| JP | 2006-327777 | A | 12/2006 |
| JP | 2014-105070 | A | 6/2014 |
| JP | 2017-137145 | A | 8/2017 |

* cited by examiner

FEEDING APPARATUS, AND IMAGE FORMING SYSTEM

BACKGROUND OF THE INVENTION

Field of the Invention

The present invention relates to a feeding apparatus that can feed sheets, and an image forming system.

Description of the Related Art

A sheet feeder (feeding apparatus) such as a side paper deck that can be separated from an image forming apparatus is known. When, for example, a jammed sheet is to be removed, the sheet feeder is separated from the image forming apparatus. Assume that the sheet feeder is connected to the image forming apparatus after they are separated from each other and a sheet is removed. In this case, when the moving direction of the sheet feeder coincides with the direction in which the sheet is conveyed from the sheet feeder to the image forming apparatus, a strong force acts on the sheet in the conveying direction. As a result, the sheet sometimes enters a roller pair that conveys the sheet in the sheet feeder.

A sheet feeder is sometimes configured to allow a sheet storage unit to be pulled out in a direction perpendicular to the conveying direction at the time of sheet replenishment. In this case, when the sheet storage unit is pulled out while a sheet has entered a roller pair, the sheet storage unit is pulled out while the sheet is caught by the roller pair, resulting in ripping the sheet.

As described in Japanese Patent Laid-Open No. 2014-105070, in order to solve such a problem, when a sheet storage cassette is separated from the main body, a sheet feeding path from the sheet storage cassette to a roller pair is shut off, and when the sheet storage cassette is attached to the main body, the shutting off of the sheet feeding path is canceled.

The technique disclosed in Japanese Patent Laid-Open No. 2014-105070 can prevent a sheet from entering the roller pair when the sheet storage cassette is attached to the main body. However, providing a dedicated mechanism will lead to increases in the complexity and cost of the apparatus.

SUMMARY OF THE INVENTION

According to an embodiment of the present invention, a feeding apparatus, which feeds sheets to an apparatus serving as a feeding destination, comprises a sheet storage unit configured to store the sheets and be able to be pulled out from the feeding apparatus; a stacking unit which is liftably and lowerably arranged inside the sheet storage unit and on which the sheets are stacked; a conveying unit including a roller pair configured to convey a sheet, of the sheets stacked on the stacking unit, which is fed from a predetermined height; and a detection unit configured to detect a connected state in which the feeding apparatus is connected to the apparatus serving as the feeding destination so as to allow a sheet to be fed and a separated state in which the feeding apparatus is separated from the apparatus serving as the feeding destination; and a control unit configured to place the sheet stacked on the stacking unit at the predetermined height when the detection unit detects the connected state while the sheet storage unit is inserted in the feeding apparatus and configured to lower the stacking unit so as to place the sheet at the predetermined height stacked on the stacking unit to a position lower than the predetermined height in accordance with detection of a change from the connected state to the separated state by the detection unit.

According to another embodiment of the present invention, a feeding apparatus, which feeds sheets to an apparatus serving as a feeding destination, comprises a sheet storage unit configured to store the sheets and be able to be pulled out from the feeding apparatus; a stacking unit which is liftably and lowerably arranged inside the sheet storage unit and on which the sheets are stacked; a conveying unit including a roller pair configured to convey a sheet, of the sheets stacked on the stacking unit, which is fed from a predetermined height; a detection unit configured to detect a connected state in which the feeding apparatus is connected to the apparatus serving as the feeding destination so as to allow a sheet to be fed and a separated state in which the feeding apparatus is separated from the apparatus serving as the feeding destination; and a control unit configured to place the sheet stacked on the stacking unit at a position lower than the predetermined height when the detection unit detects the separated state while the sheet storage unit is inserted in the feeding apparatus and configured to lift the stacking unit so as to place the sheet at a position lower than the predetermined height stacked on the stacking unit to the predetermined height in accordance with detection of a change from the separated state to the connected state by the detection unit.

According to an embodiment of the present invention, it is possible to prevent a sheet from entering a roller pair when a feeding apparatus is connected to an apparatus as the feeding destination of the sheet.

Further features of the present invention will become apparent from the following description of exemplary embodiments (with reference to the attached drawings).

DESCRIPTION OF THE EMBODIMENTS

Figure 1A:
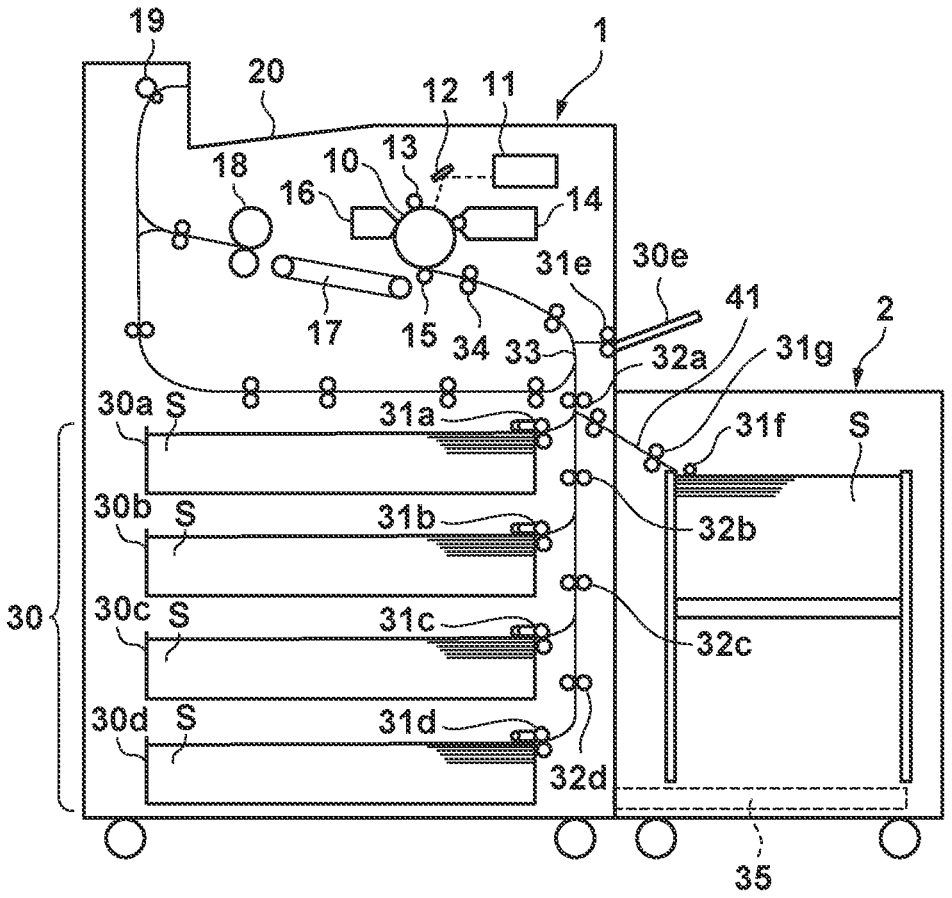
FIG. 1A is a view showing the arrangement of an image forming apparatus and a state in which a paper feed deck is attached to the apparatus main body.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same elements, and a repetitive explanation will be omitted.

<Schematic Arrangement of Image Forming Apparatus>

Figure 1B:
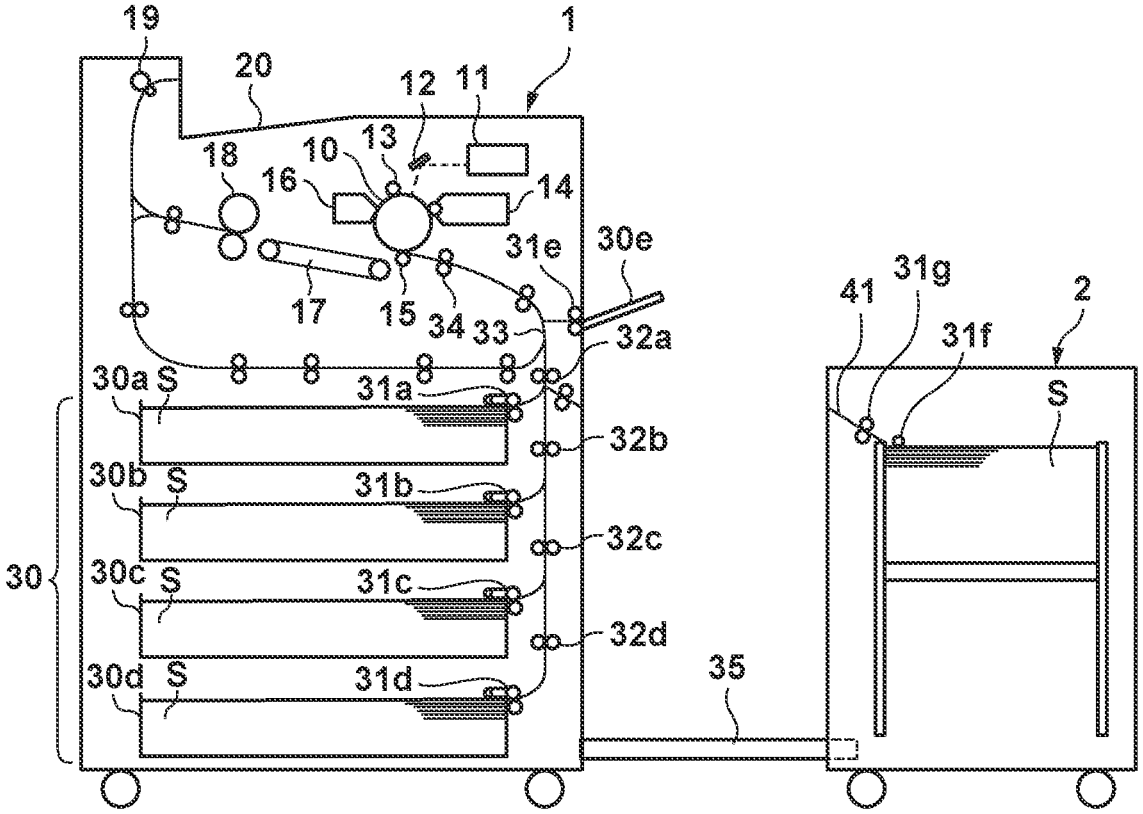
FIG. 1B is a view showing the arrangement of the image forming apparatus and a state in which the paper feed deck is separated from the apparatus main body.

FIGS. 1A and 1B show the arrangement of an image forming system 100 according to this embodiment. The image forming system 100 includes an apparatus main body 1 and a paper feed deck 2 (feeding apparatus). FIG. 1A shows a state (connected state) in which the paper feed deck 2 is attached to the apparatus main body 1. FIG. 1B shows a state (separated state) in which the paper feed deck 2 is separated from the apparatus main body 1. When the paper feed deck 2 is attached to the apparatus main body 1, the paper feed deck 2 is connected to the apparatus main body 1 via a feeding path 41. While the paper feed deck 2 is separated from the apparatus main body 1, for example, the user can remove a sheet S that has caused a jam.

The apparatus main body 1 includes, on its upper portion, a photosensitive drum 10, a laser scanner 11, a mirror 12, a charger 13, a developing device 14, a transfer roller 15, and a cleaner 16 as components of an image forming unit that forms an image on a printing medium. The charger 13 uniformly charges the surface of the photosensitive drum 10. The laser scanner 11 irradiates the photosensitive drum 10 charged by the charger 13 with a pattern of image data of an image formation target via the mirror 12. As a result, an electrostatic latent image is formed on the photosensitive drum 10. The developing device 14 develops the electrostatic latent image formed by the laser scanner 11 into a toner image. The transfer roller 15 transfers the toner image visualized on the surface of the photosensitive drum 10 onto the sheet S. The cleaner 16 removes toner left on the photosensitive drum 10 after the toner image is transferred. Although FIGS. 1A and 1B show the arrangement based on electrophotography, the apparatus main body 1 may adopt another printing scheme such as an inkjet printing scheme.

A conveying unit 17 and a fixing device 18 are provided on the downstream side of the image forming unit in the sheet conveying direction. The conveying unit 17 conveys the sheet S onto which the toner image has been transferred. The fixing device 18 fixes, as a permanent image, the toner image on the sheet S conveyed by the conveying unit 17. In addition, delivery rollers 19 are provided on the downstream side of the fixing device 18. The delivery rollers 19 deliver the sheet S, on which the toner image has been fixed by the fixing device 18, out of the apparatus main body 1. A delivered sheet stacking tray 20 is provided outside the upper portion of the apparatus main body 1. The delivered sheet stacking tray 20 receives the sheet S delivered by the delivery rollers 19.

Cassette paper feed trays 30*a* to 30*d* are provided on the most upstream side of the sheet feeding path, and can store a predetermined number of sheets S. Cassette paper feed roller pairs 31*a* to 31*d* are provided downstream of the cassette paper feed trays 30*a* to 30*d*, and pick up the uppermost sheet S from bundles of sheets. The picked up sheet S is conveyed to a vertical convey path 33 by pull-out roller pairs 32*a* to 32*d*. A manual paper feed unit 30*e* is provided on a side surface of the apparatus main body 1. A manual paper feed roller pair 31*e* is provided downstream of the manual paper feed unit 30*e*, and picks up a sheet S. The picked up sheet S is conveyed to the vertical convey path 33.

The paper feed deck 2 is configured to allow stacking of a relatively large number of sheets S in bundles of 1,000 sheets or the like. In this embodiment, the paper feed deck 2 is configured to be connectable to the lower portion of the manual paper feed unit 30*e*. The paper feed deck 2 conveys the uppermost sheet S from a bundle of sheets stacked and stored until the sheet S is nipped by a paper feed roller pair 31*g* by a pickup roller 31*f*. The paper feed roller pair 31*g* separates the sheets S and feeds them one by one to the apparatus main body 1 side (downstream side) as a feeding destination. As described above, in the paper feed deck 2, the stacking of the sheets S occupies a large space. For this reason, from a structural point of view, the fed portion of the sheet S picked up by the pickup roller 31*f* is positioned at a height that allows the sheet to be directly fed to paper feed roller pair 31*g*.

The sheet S is conveyed to the vertical convey path 33 by the pull-out roller pair 32*a*. A registration roller pair 34 positioned on the most downstream side of the vertical convey path 33 performs skew correction of the sheet S and matches the image writing timing with the sheet conveying timing. As shown in FIG. 1B, when the paper feed deck 2 is separated from the apparatus main body 1 to perform jam processing or the like, the paper feed deck 2 is moved along an attaching/detaching rail 35 housed in the paper feed deck 2 in FIG. 1A so as to be separated from the apparatus main body 1.

<Schematic Arrangement of Paper Feed Deck>

Figure 2:
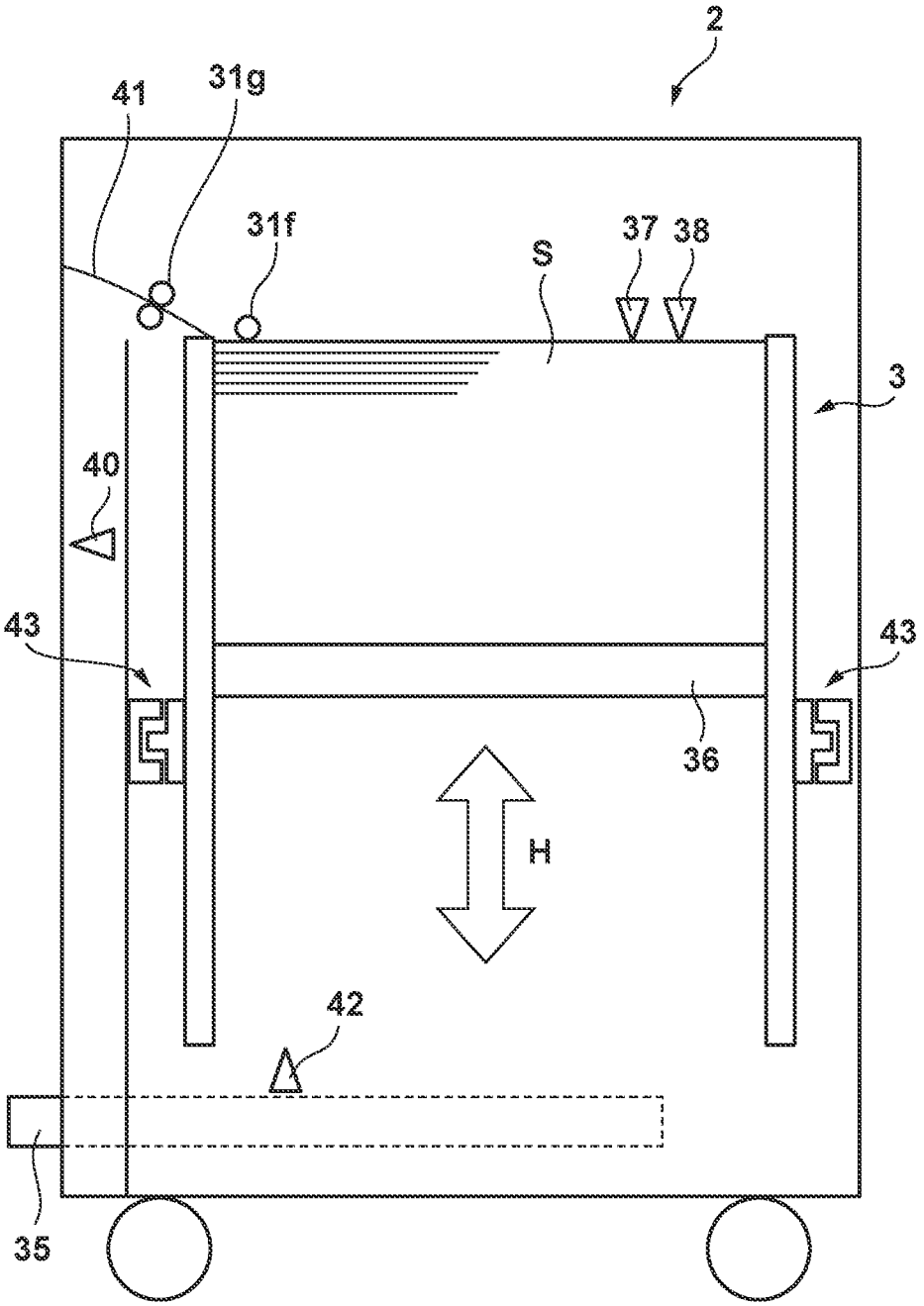
FIG. 2 is a view showing the arrangement of a paper feed deck unit.

FIG. 2 shows a schematic arrangement of the paper feed deck 2. The paper feed deck 2 includes a sheet storage unit 3 that stores the sheets S, the pickup roller 31*f* (pickup unit), the paper feed roller pair 31*g* (conveying unit), and an attachment/detachment sensor 40.

The sheet storage unit 3 accommodated in the paper feed deck 2 includes a stacking unit 36 on which the sheets S can be stacked, a sheet presence/absence sensor 37 (sheet detection unit) that detects the presence/absence of the sheet S on the stacking unit 36, an upper surface detection sensor 38 (sheet height detection unit) that detects the upper surface of the stacked sheet S, and a lower limit detection sensor 42 that detects a lowest limit when the stacking unit 36 is lowered. The sheet storage unit 3 is configured to be able to be pulled out along a pull-out rail 43 from the state in which the sheet storage unit 3 is accommodated in the paper feed deck 2 in a direction intersecting the paper feeding direction. The sheet presence/absence sensor 37 and the upper surface detection sensor 38 are configured to have, for example, flag portions (not shown). The sheet presence/absence sensor 37 is, for example, a distance measuring sensor. The detection point of the sheet presence/absence sensor 37 is provided below the detection point of the upper surface detection sensor 38. The stacking surface of the stacking unit 36 is provided with a concave portion (for example, a groove) for allowing the sheet presence/absence sensor 37 to detect the presence/absence of the sheet S. When the sheets S are stacked on the stacking unit 36, the upper surface detection sensor 38 detects the uppermost surface of the stacked sheets S. When no sheet S is stacked on the stacking unit 36, the upper surface detection sensor 38 detects the stacking surface of the stacking unit 36.

The stacking unit 36 on which the sheets S are stacked can be moved in an H direction (lifting and lowering direction) in FIG. 2 by a lifting mechanism (not shown) that can lift and lower the stacking unit 36. Based on the detection results respectively obtained by the sheet presence/absence sensor 37 and the upper surface detection sensor 38, the stacking unit 36 is controlled such that the uppermost surface of the bundle of sheets stacked and stored is always positioned at a height suitable for paper feeding.

The paper feed deck 2 is provided with the attachment/detachment sensor 40. The attachment/detachment sensor 40

(detection unit) detects whether the paper feed deck 2 is connected to the apparatus main body 1 via the feeding path 41 for feeding the sheet S or separated from the apparatus main body 1, that is, whether the paper feed deck 2 is in a connected state or a separated state. The attaching/detaching rail 35 has, for example, a mechanism for extending and retracting. In this embodiment, the attaching/detaching rail 35 is accommodated in the paper feed deck 2 when the paper feed deck 2 is attached to the apparatus main body 1. In addition, the attaching/detaching rail 35 may be configured to be accommodated in the apparatus main body 1 when the paper feed deck 2 is attached to the apparatus main body 1.

As described above, from a structural point of view, the sheet S picked up by the pickup roller 31*f* is positioned at a height that allows direct sheet feeding to the paper feed roller pair 31*g*. That is, when the paper feed deck 2 is attached to the apparatus main body 1, the moving direction of the paper feed deck 2 almost coincides with the direction in which the sheet S is conveyed from the paper feed deck 2 to the apparatus main body 1. The feeding path 41 is almost flush with the sheet upper surface. Accordingly, if a strong force acts on the sheet S in the conveying direction in accordance with momentum with which the paper feed deck 2 is attached to the apparatus main body 1, the sheet S sometimes enters the paper feed roller pair 31*g* of the paper feed deck 2. In addition, the sheet S sometimes enters and extends over the apparatus main body 1 via the paper feed roller pair 31*g*. In this case, even if the user solves the paper jam problem and attaches the paper feed deck 2 to the apparatus main body 1, the jammed state remains. In addition, if the user pulls out the sheet storage unit 3 in such a state, the sheet S at the jammed position tears.

Accordingly, in this embodiment, when the paper feed deck 2 is separated from the apparatus main body 1, the lifting mechanism is controlled to lower the upper surface position of the sheet S. This configuration can prevent the sheet S from entering the paper feed roller pair 31*g* even if the sheet S is biased in the attaching direction, that is, the direction of the feeding path 41, when the paper feed deck is attached to the main body.

Figure 3:
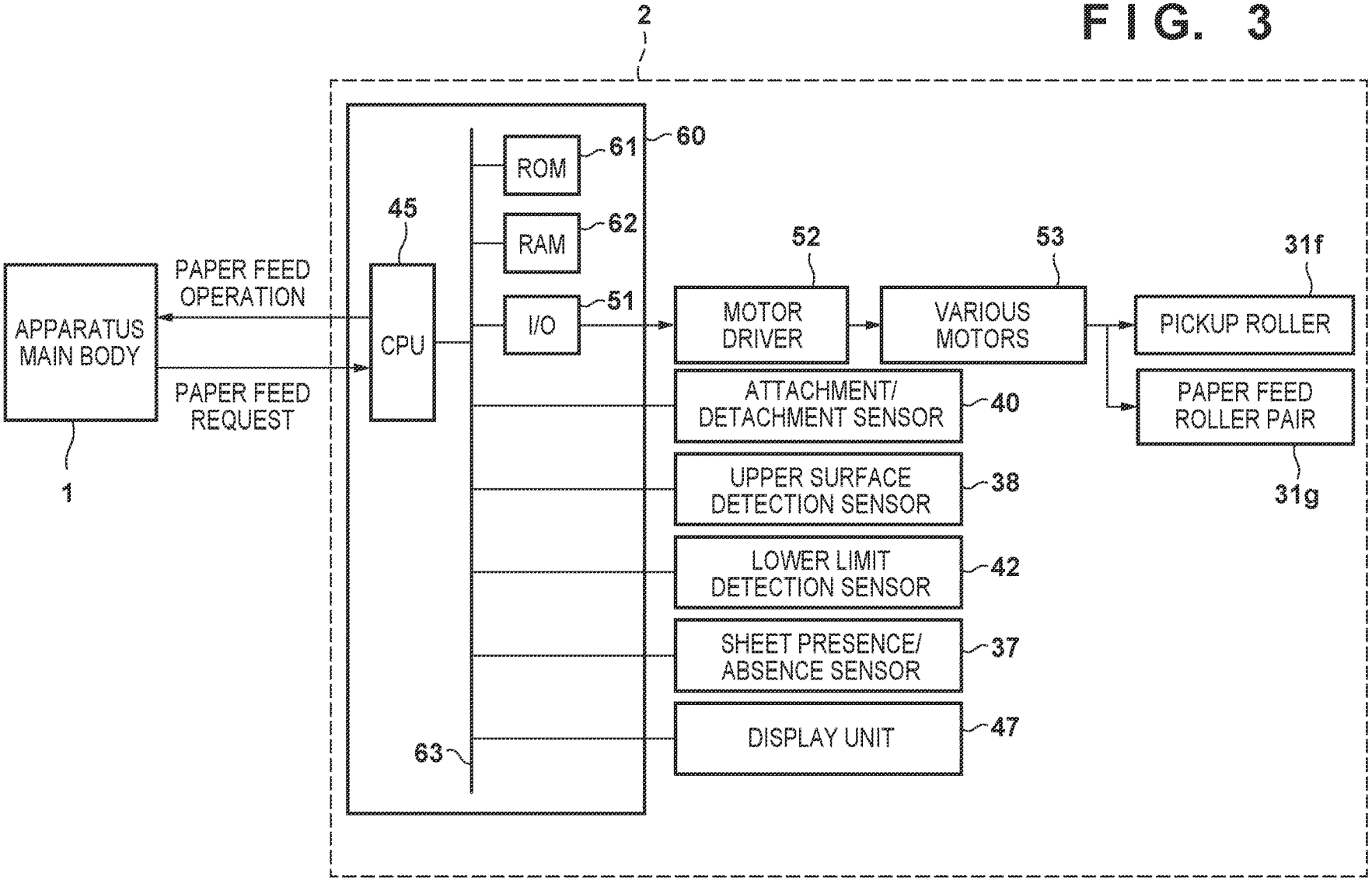
FIG. 3 is a block diagram showing the arrangement of a control system in a feeding apparatus.

FIG. 3 is a block diagram showing the arrangement of the control system of the paper feed deck 2. FIG. 3 shows the apparatus main body 1 and the paper feed deck 2. The paper feed deck 2 includes a display unit 47 (notification unit). The display unit 47 includes, for example, an operation panel, and is formed on the upper portion of the paper feed deck 2. The display unit 47 displays various types of user interface screens such as an apparatus information screen, a setting screen, and a job information screen. The display unit 47 also includes, for example, a hard key to accept a job execution instruction and a function setting operation from the user. The apparatus main body 1 in FIG. 4 includes a controller including a CPU, which systematically controls the apparatus main body 1 based on a job and the like. For example, the CPU of the apparatus main body 1 mutually communicates with a CPU 45 of the paper feed deck 2, and controls a series of processing operations from paper feeding to image formation on a printing medium.

A controller 60 of the paper feed deck 2 includes the CPU 45 (control unit), a ROM 61, and a RAM 62. For example, the controller 60 controls operation of the paper feed deck 2 by causing the CPU 45 to load a program stored in the ROM 61 into the RAM 62 and execute the program. For example, the CPU of the apparatus main body 1 transmits a paper feed request to the CPU 45 of the paper feed deck 2 at a paper feed timing at the time of job execution. Upon reception of the paper feed request from the CPU of the apparatus main body 1, the CPU 45 controls the paper feed deck 2 to execute a paper feed operation with respect to the apparatus main body 1. The respective constituent elements of the controller 60 are mutually connected via a bus 63. The bus 63 functions as a data communication path between various constituent elements.

Detection signals from the sheet presence/absence sensor 37, the upper surface detection sensor 38, the attachment/detachment sensor 40, and the lower limit detection sensor 42 are transmitted to the CPU 45. When lifting the stacking unit 36, the CPU 45 lifts the stacking unit 36 until the upper surface detection sensor 38 detects the upper surface. When the upper surface detection sensor 38 detects the upper surface, the stacking unit 36 is positioned at a height at which the feeding path 41 is almost flush with the sheet upper surface, and the sheet S can be fed to the apparatus main body 1. In this case, when the sheet S is stacked on the stacking unit 36, the sheet S turns on the sheet presence/absence sensor 37 to detect the present of the sheet. In contrast, when the sheet S is not stacked on the stacking unit 36, the sheet presence/absence sensor 37 is turned off to detect the absence of a sheet. When the sheet presence/absence sensor 37 detects the absence of a sheet, the CPU 45 displays, on the display unit 47, a message prompting replenishment of the sheets S.

When the attachment/detachment sensor 40 detects that the apparatus main body 1 is separated from the paper feed deck 2, the CPU 45 lowers the stacking unit 36 by a predetermined amount. Subsequently, when the attachment/detachment sensor 40 detects that the paper feed deck 2 is attached to the apparatus main body 1, the CPU 45 lifts the stacking unit 36 to a height that allows feeding of the sheet S to the apparatus main body 1. Control to be performed at the time of attaching/detaching the paper feed deck will be described in detail later.

The CPU 45 further drives various motors 53 on the convey paths of the sheet S including the feeding path 41 via a motor driver 52 connected to an input/output interface (I/O) 51 to drive various rollers. In this case, the various rollers include the pickup roller 31*f* and the paper feed roller pair 31*g*.

<Flowchart for Lifting/Lowering Control on Stacking Unit>

Figure 4:
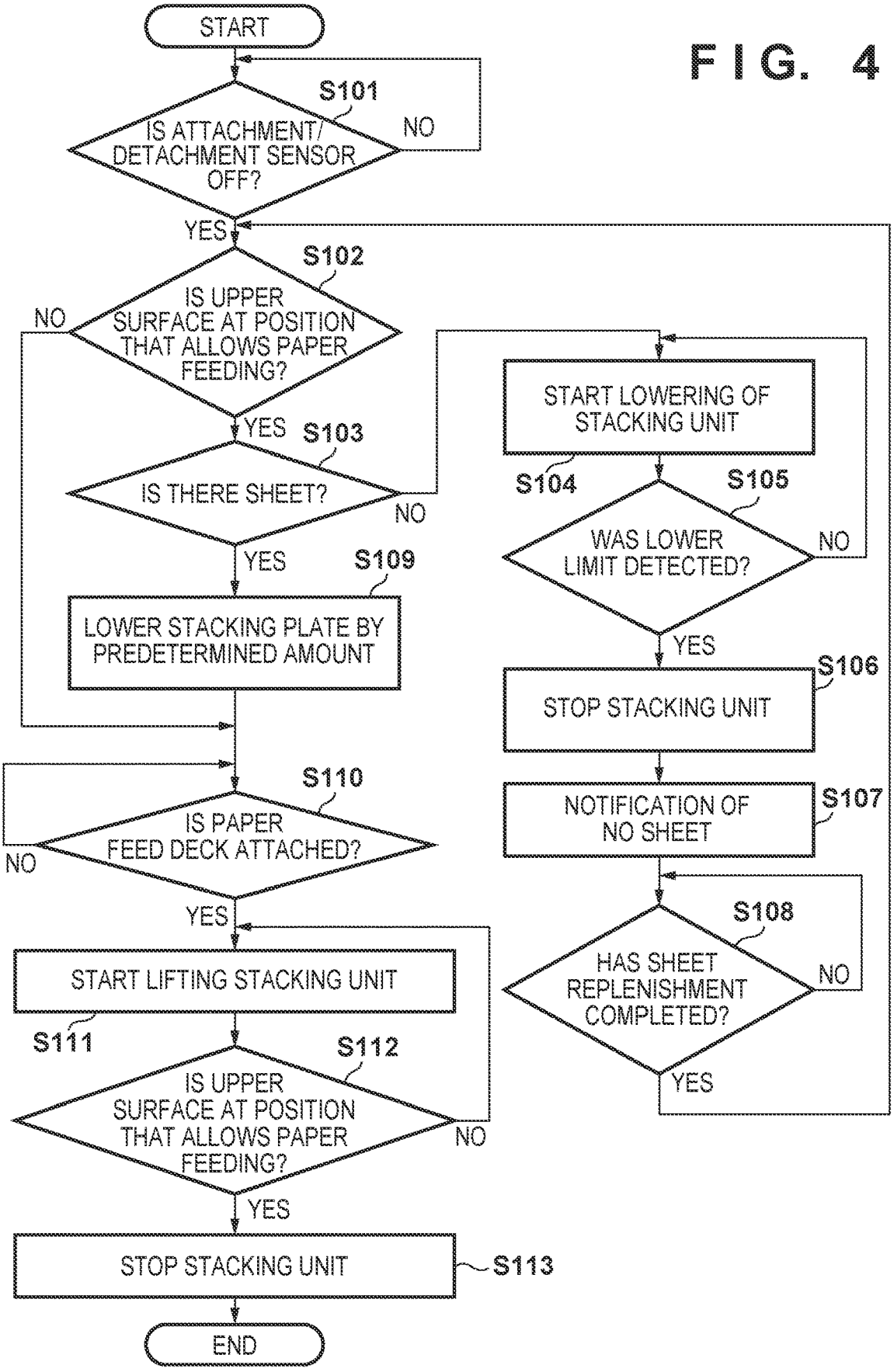
FIG. 4 is a flowchart for stacking unit drive control at the time of separating the paper feed deck unit.

FIG. 4 is a flowchart showing a processing procedure for lifting/lowering control on the stacking unit when the paper feed deck 2 is separated from the apparatus main body 1. The processing shown in FIG. 4 can prevent the sheet S from entering the paper feed nip portion of the paper feed roller pair 31*g* even if the sheet S is biased in the direction of the convey path when the paper feed deck 2 is attached to the apparatus main body 1. The CPU 45 implements the processing in FIG. 4 by loading a program stored in the ROM 61 into the RAM 62 and executing the program. The CPU 45 starts the processing in FIG. 4 when, for example, the power supply of the apparatus main body 1 is turned on.

In step S101, the CPU 45 detects an output signal from the attachment/detachment sensor 40 to determine whether the paper feed deck 2 is separated from the apparatus main body 1 while the sheet storage unit 3 is inserted in the paper feed deck 2. If the output from the attachment/detachment sensor 40 is ON, the CPU 45 determines that the paper feed deck 2 is attached to the apparatus main body 1, and repeats the processing in step S101. Upon determining in step S101 that the output from the attachment/detachment sensor 40 is OFF, the CPU 45 determines that the paper feed deck 2 is separated from the apparatus main body 1. The process then advances to step S102.

In step S102, in order to determine whether the upper surface of the stacking unit 36 or the sheet S is at a height that allows paper feeding to the apparatus main body 1, the CPU 45 detects an output signal from the upper surface detection sensor 38. If the output from the upper surface detection sensor 38 is OFF, the CPU 45 determines that the height of the upper surface of the stacking unit 36 or the sheet S is lower than the height that allows paper feeding to the apparatus main body 1. The process then advances to step S110 while the height of the stacking unit 36 is maintained. In contrast, upon determining in step S102 that the output from the upper surface detection sensor 38 is ON, the CPU 45 determines that the upper surface of the stacking unit 36 or the sheet S is at the height that allows paper feeding to the apparatus main body 1. The process then advances to step S103.

In step S103, in order to determine whether the sheet S is stacked, the CPU 45 detects an output signal from the sheet presence/absence sensor 37. If the output from the sheet presence/absence sensor 37 is ON, the CPU 45 determines that the sheet S is stacked. The process then advances to step S109. In contrast to this, if the output from the sheet presence/absence sensor 37 is OFF, the CPU 45 determines that no sheet S is stacked. The process then advances to step S104.

In step S104, the CPU 45 starts lowering the stacking unit 36. In step S105, in order to determine whether the stacking unit 36 has reached the lowest limit position, the CPU 45 detects an output signal from the lower limit detection sensor 42. If the output from the lower limit detection sensor 42 is OFF, the CPU 45 determines that the stacking unit 36 has not yet reached the lower limit. The process then returns to step S104. In contrast to this, if the output from the lower limit detection sensor 42 is ON, the CPU 45 determines that the stacking unit 36 has reached the lowest limit. The process then advances to step S106 to stop lowering the stacking unit 36. The process then advances to step S107.

In step S107, the CPU 45 displays, on the display unit 47, a message prompting the user to replenish the sheets S. In step S108, the CPU 45 determines whether the sheets S have been replenished. Upon determining that the replenishment of the sheets S is not completed, the CPU 45 repeats the processing in step S108. In contrast, upon determining that the replenishment of the sheets S is completed, the CPU 45 returns to the processing in step S102. For example, whether the replenishment of the sheets S is completed is determined based on whether the sheet storage unit 3 is inserted in the paper feed deck 2.

Note that after the CPU 45 stops lowering the stacking unit 36 in step S106, the CPU 45 may lift the stacking unit 36, and the process may advance to step S107. The position of the stacking unit 36 at this time is the position of the stacking unit 36 in step S109 in which the stacking unit 36 is lowered by the predetermined amount. With this operation, when the user receives the sheet absence notification in step S107 and replenishes the sheets S, the CPU 45 has lifted the stacking unit 36. Accordingly, when the user replenishes the sheets S until the upper surface of the sheet S reaches the position that allows paper feeding, and the process advances from steps S102 and S103 to step S109 while continuing the processing in FIG. 4, the CPU 45 can lower the stacking unit 36 by a predetermined amount.

In step S109, the CPU 45 lowers the stacking unit 36 by a predetermined amount. The process then advances to step S110. Upon lowering the stacking unit 36 by the predetermined amount in step S109, the CPU 45 displays, on the display unit 47, the message "the paper feed deck 2 can be connected to the apparatus main body 1". In step S110, the CPU 45 detects an output signal from the attachment/detachment sensor 40 to determine whether the paper feed deck 2 is attached to the apparatus main body 1 while the sheet storage unit 3 is inserted in the paper feed deck 2. If the output from the attachment/detachment sensor 40 is OFF, the CPU 45 determines that the paper feed deck 2 is separated from the apparatus main body 1, and repeats the processing in step S113. In contrast, upon determining that the output from the attachment/detachment sensor 40 is ON, the CPU 45 determines that the paper feed deck 2 is attached to the apparatus main body 1. The process then advances to step S111.

In step S111, the CPU 45 starts lifting the stacking unit 36. In step S112, the CPU 45 determines, by processing similar to that in step S102, whether the upper surface of the stacking unit 36 or the sheet S is at the height that allows paper feeding to the apparatus main body 1. When the CPU 45 determines that the upper surface has not reached the height that allows paper feeding, the process returns to step S111. When the CPU 45 determines that the upper surface has reached to the height allowing paper feeding, the process advances to step S113 to stop lifting the stacking unit 36. Subsequently, the CPU 45 terminates the processing in FIG. 4.

The above processing can prevent the sheet S from entering the paper feed roller pair 31*g* when the paper feed deck 2 that has been separated from the apparatus main body 1 is attached to the apparatus main body 1.

<Arrangement at Time of Lowering Stacking Unit by Processing in Step S109>

Figure 5A:
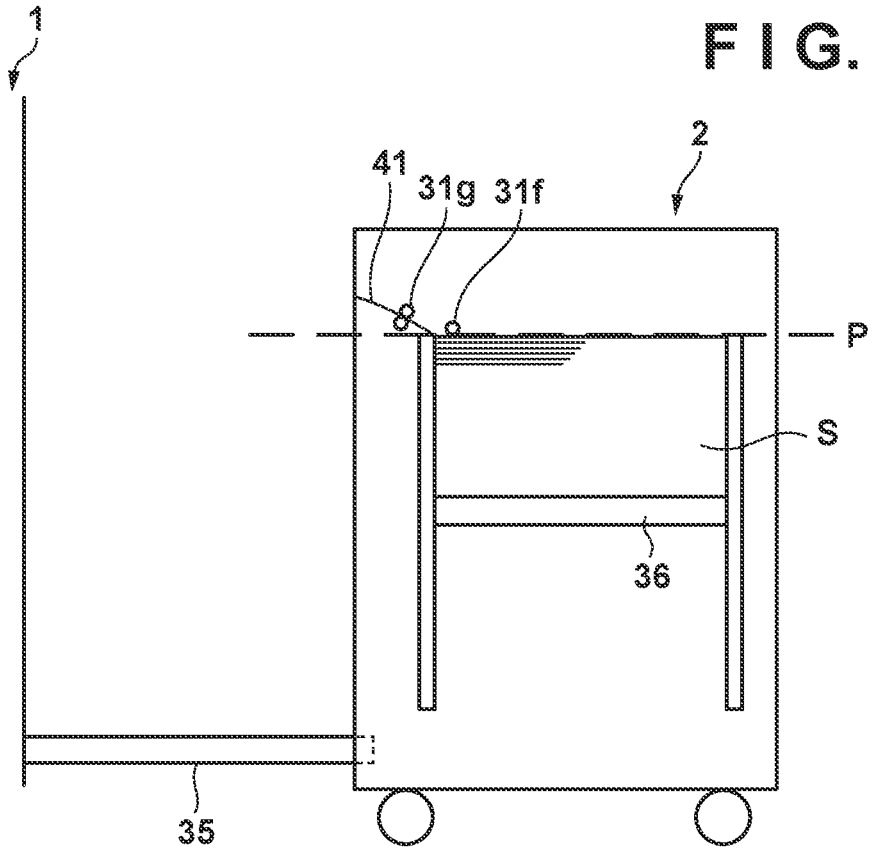
FIG. 5A is a schematic view showing a state in which the upper surface of a stacked sheet is at a height that allows paper feeding at the time of separating the paper feed deck unit according to an embodiment of the present invention.
Figure 5B:
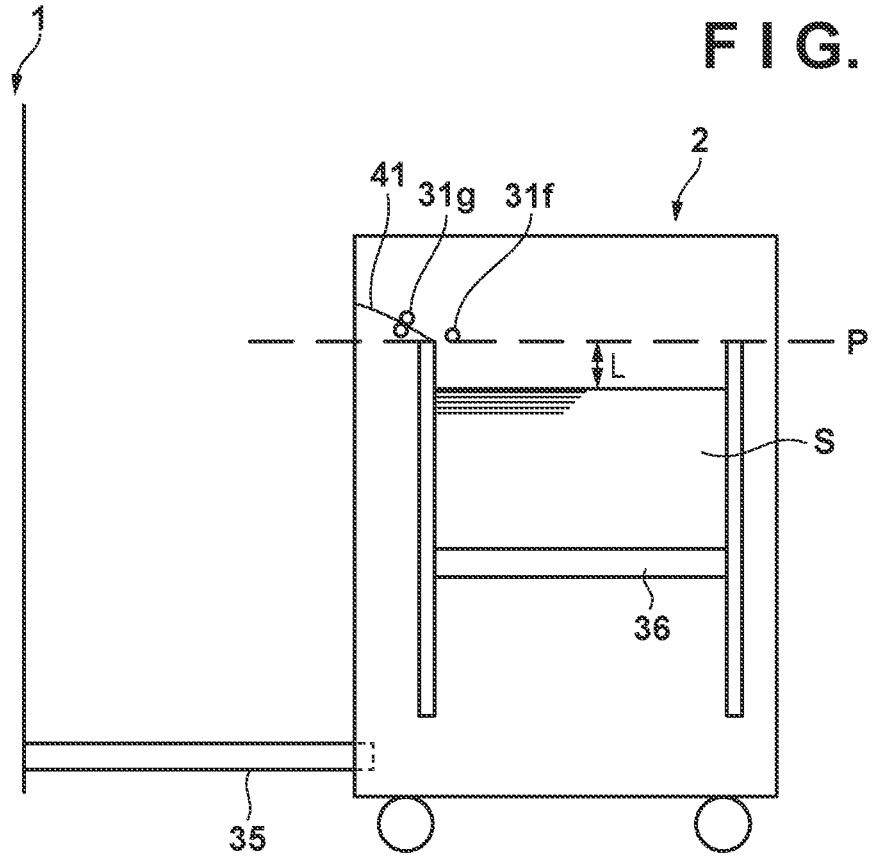
FIG. 5B is a schematic view showing a state in which the sheet surface is lowered at the time of separating the paper feed deck unit according to the embodiment of the present invention.

FIG. 5A shows a state in which the upper surface of the sheet S stacked on the paper feed deck 2 is at the height allowing paper feeding. FIG. 5B shows a state in which the upper surface of the sheet S stacked on the paper feed deck 2 is lowered from the height allowing paper feeding by a predetermined amount by the processing in step S109 in FIG. 4.

In the state shown in FIG. 5A, the upper surface of the sheet S is almost flush with the stacking unit 36 on the feeding path 41. For this reason, when the paper feed deck 2 is attached to the apparatus main body 1 with a large force, the bundle of sheets is biased in the direction of the apparatus main body 1, and the sheet S at the height of a paper feeding position P sometimes enters the paper feed nip portion of the paper feed roller pair 31*g* on the feeding path 41.

In the state shown in FIG. 5B, the height of the upper surface of the sheet S is at a position lowered from the paper feeding position P by a predetermined amount L. The position lower than the paper feeding position P by the predetermined amount L is the position at which the sheet S on the upper surface collides with a side surface of the sheet storage unit 3 and does not enter the paper feed nip portion of the paper feed roller pair 31*g*, even when the paper feed deck 2 is attached to the apparatus main body 1 with a large force and the bundle of sheets is biased in the direction of the apparatus main body 1.

That is, in this embodiment, when the paper feed deck 2 is separated from the apparatus main body 1, the stacking unit 36 is lowered by a predetermined amount L to prevent a sheet from entering the paper feed nip portion of the paper feed roller pair 31*g*. In the embodiment, the predetermined amount L by which the stacking unit 36 is lowered is, for example, 3 cm, and the position of the stacking unit 36 lowered by 3 cm is a predetermined position. Note that the predetermined amount L may be arbitrarily set in accordance with the basis weight and friction coefficient of the sheet S within the range in which any sheet does not enter the paper feed nip portion of the paper feed roller pair 31g.

According to this embodiment, when the paper feed deck 2 is separated from the apparatus main body 1, the CPU 45 lowers the upper surface of a stacked sheet to a height lower than the paper feeding position. This can prevent the sheet S from entering the paper feed nip portion of the paper feed roller pair 31g when the sheet S is biased by the force with which the paper feed deck 2 is attached to the apparatus main body 1.

In addition, according to this embodiment, when the paper feed deck 2 is attached to the apparatus main body 1 in a state in which the upper surface of the stacked sheet S is lowered by the predetermined amount upon separation of the paper feed deck 2 from the apparatus main body 1, the CPU 45 lifts the upper surface of the sheet S to the height allowing paper feeding. Accordingly, even in a state in which the upper surface of the sheet S is lowered by the predetermined amount, when the paper feed deck 2 is attached to the apparatus main body 1, the upper surface of the sheet S is at a height that allows the sheet S to be fed from the paper feed deck 2 to the apparatus main body. In addition, according to this embodiment, upon detecting that no sheet S is stacked when the paper feed deck 2 is separated from the apparatus main body 1, the CPU 45 lowers the stacking unit 36 to the lowest limit instead of lowering the stacking unit 36 by the predetermined amount. Accordingly, when no sheet S is stacked, the user can replenish the sheets S while the stacking unit 36 is lowered to the lowest limit.

Other Embodiments

According to the above embodiment, when the sheet presence/absence sensor 37 is OFF, the CPU 45 lowers the stacking unit 36 to the position of the lower limit detection sensor 42. However, the present invention is not limited to this. For example, it is possible to define in advance, as a sheet replenishment position, a height between the uppermost surface and the lowest limit, at which the user can easily replenish sheets, and cause the CPU 45 to lower the stacking unit 36 to the sheet replenishment position. In this case, this apparatus is provided with a position detection sensor that detects that the stacking unit 36 has reached the defined sheet replenishment position. In this arrangement, in step S105 in the flowchart of FIG. 4, the CPU 45 determines whether the position detection sensor detects that the stacking unit 36 has reached the sheet replenishment position. The CPU 45 starts lowering the stacking unit 36 in the processing in step S104 at the time of sheet replenishment, and stops lowering the stacking unit 36 in the processing in step S106 upon detection of the sheet replenishment position in the processing in step S105. This arrangement makes it easy for the user to replenish sheets because the stacking unit stops at the height that allows easy replenishment of sheets.

In addition, a plurality of position detection sensors may be provided or the lower limit detection sensor 42 and one or more position detection sensors may be simultaneously provided. A plurality of position detection sensors may be provided at, for example, heights of ¼, ⅔, and ¾ of the height from the lowest limit to the uppermost surface. In this case, this apparatus may be configured to allow the user to select a desired sheet replenishment position in advance from sheet replenishment positions detected by the lower limit detection sensor 42 or the plurality of position detection sensors by operating the operation panel of the display unit 47. The CPU 45 starts lowering the stacking unit 36 in the processing in step S104, and stops lowering the stacking unit 36 in the processing in step S106 when the lower limit detection sensor 42 or the position detection sensor corresponding to the height of the selected replenishment position detects the stacking unit 36 in the processing in step S105. The above arrangement allows the user to select the height of the stacking unit 36 at the time of sheet replenishment from a plurality of heights.

Note that the number of position detection sensors is not limited, and may be two or less or four or more. In addition, the position of the position detection sensor is not limited to the above position and can be arbitrarily set. For example, the user can efficiently replenish sheets by setting the distance from the uppermost surface to the sheet replenishment position to an integer multiple of a predetermined thickness of a bundle of sheets to be replenished.

In addition, the paper feed deck 2 may be configured to have no CPU. In this case, the CPU as the control unit of the apparatus main body 1 controls the stacking unit 36 of the paper feed deck 2. Alternatively, the paper feed deck 2 may include an ASIC for control. The ASIC of the paper feed deck controls the stacking unit 36 based on commands from the CPU of the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226028, filed Nov. 24, 2017, and Japanese Patent Application No. 2018-211660, filed Nov. 9, 2018, which are hereby incorporated by reference herein in their entirety.

What is claimed is:

1. A feeding apparatus that feeds sheets to an apparatus serving as a feeding destination, the feeding apparatus comprising:

a sheet storage unit configured to store the sheets, the sheet storage unit being movable between a first position where the sheet storage unit is accommodated at least partially within the feeding apparatus and a second position where the sheet storage unit is pulled out from the feeding apparatus, the sheet storage unit including a stacking unit which is liftably and lowerably arranged inside the sheet storage unit and on which the sheets are stacked;

a conveying unit including a roller pair configured to convey a sheet, of the sheets stacked on the stacking unit, which is fed from a predetermined height, wherein the conveying unit is provided within the feeding apparatus in a state that the sheet storage unit is at the first position and in a state that the sheet storage unit is at the second position;

a connection/separation detection unit configured to detect a connected state in which the feeding apparatus is connected to the apparatus serving as the feeding destination so as to allow a sheet to be fed and a separated state in which the feeding apparatus is separated from the apparatus serving as the feeding destination;

a sheet detection unit configured to detect presence and absence of a sheet on the stacking unit; and a control unit configured to:

move the stacking unit to a position where the sheet on the stacking unit is at the predetermined height in response to the sheet detection unit detecting presence of a sheet when the connection/separation detection unit detects that the feeding apparatus changes from the separated state to the connected state in a state in which the sheet storage unit is in the first position, and move the stacking unit to a position where the sheet on the stacking unit is lower than the predetermined height and higher than a lowest limit position in a movable range of the stacking unit in response to the sheet detection unit detecting presence of a sheet when the connection/separation detection unit detects that the feeding apparatus changes from the connected state to the separated state in a state in which the sheet storage unit is in the first position.

2. The feeding apparatus according to claim 1, wherein the control unit lifts the stacking unit so as to move the sheet stacked on the stacking unit from a position lower than the predetermined height to the predetermined height in accordance with detection of a change from the separated state to the connected state by the connection/separation detection unit.

3. The feeding apparatus according to claim 1, wherein the control unit lowers the stacking unit to a height that inhibits the sheet from entering a nip formed by the roller pair when the connection/separation detection unit detects the separated state.

4. The feeding apparatus according to claim 1, wherein the control unit moves the stacking unit to a lower limit position in response to the sheet detection unit detecting absence of a sheet when the connection/separation detection unit detects that the feeding apparatus changes from the connected state to the separated state.

5. The feeding apparatus according to claim 4, further comprising a notification unit configured to notify that a sheet is absent when the sheet detection unit detects absence of the sheet.

6. The feeding apparatus according to claim 4, wherein when it is determined that a sheet is present on the stacking unit and the sheet stacked on the stacking unit is not placed at a position that allows the sheet stacked on the stacking unit to be fed to the apparatus serving as the feeding destination, the control unit maintains a height of the stacking unit.

7. The feeding apparatus according to claim 1, further comprising a sheet height detection unit configured to detect presence and absence of a sheet at the predetermined height, wherein the control unit lowers the stacking unit when the sheet storage unit is at the first position while the detection unit detects the separated state, and the sheet height detection unit detects a sheet at the predetermined height.

8. The feeding apparatus according to claim 1, further comprising a pickup unit configured to supply the sheet, of sheets stacked on the stacking unit, which is located at the predetermined height to the roller pair of the conveying unit.

9. An image forming system comprising:

the feeding apparatus defined in claim 1; and an image forming apparatus as the apparatus serving as the feeding destination and configured to form an image on a sheet fed from the feeding apparatus.

10. The feeding apparatus according to claim 1, wherein the lowest limit position is a position of the stacking unit for stacking sheets on the stacking unit when absence of a sheet is detected by the sheet detection unit.

* * * * *